US006116558A

United States Patent [19]

Yano

[11] Patent Number: 6,116,558

[45] Date of Patent: Sep. 12, 2000

[54] DUMMY TERMINAL MOUNTING CONSTRUCTION

[75] Inventor: Keisuke Yano, Kyoto, Japan

[73] Assignee: Omron Corporation, Kyoto, Japan

[21] Appl. No.: 09/049,296

[22] Filed: Mar. 27, 1998

[30] Foreign Application Priority Data

Mar. 31, 1997 [JP] Japan ..... 9/080259

[51] Int. Cl.[7] ..... A47G 1/10

[52] U.S. Cl. ..... 248/316.7; 248/27.3; 439/746

[58] Field of Search ..... 248/686, 689, 248/316.7, 316.1, 316.2, 27.3, 27.1; 439/746

[56] References Cited

U.S. PATENT DOCUMENTS

| | | | |
|---|---|---|---|
| 2,627,385 | 2/1953 | Tinnerman | 248/27.3 |
| 2,873,082 | 2/1959 | Gillespie | 248/316.7 X |
| 3,029,057 | 4/1962 | Ferm | 248/316.7 |
| 3,531,076 | 9/1970 | Bang | 248/316.7 |
| 4,535,534 | 8/1985 | Ohashi et al. | 29/832 |
| 4,710,139 | 12/1987 | Shichida | 439/746 X |
| 4,875,872 | 10/1989 | Tanaka | 439/746 X |
| 5,169,097 | 12/1992 | Yasukawa | 248/27.1 |

*Primary Examiner*—Ramon O. Ramirez
*Assistant Examiner*—Tan Le
*Attorney, Agent, or Firm*—Morrison & Foerster, LLP

[57] ABSTRACT

A dummy terminal mounting construction includes a housing having hook projections disposed on opposing side walls of the housing, a dummy terminal of a C-shape in a plane having at least one projection terminal portion and hook arm portions extending from both ends of the terminal, the hook arm portions being provided with hook holes, wherein the dummy terminal is mounted on the housing by engaging the hook holes with the hook projections.

3 Claims, 13 Drawing Sheets

DUMMY TERMINAL MOUNTING CONSTRUCTION

BACKGROUND OF THE INVENTION

1. Field of the Invention

This invention relates to a mounting construction for a dummy terminal, and more particularly to an improved construction for a dummy terminal electrically insulated from internal components to be mounted on a printed circuit board.

2. Discussion of the Related Art

Referring to FIGS. 12 and 13, there is shown an electromagnetic relay provided with a pair of dummy terminals 3 mounted on a ceiling wall of a box-shaped housing 1 as a conventional dummy terminal mounting construction. The housing 1 on the upper wall thereof is provided with a pair of opposing press-fit grooves 2 having L-shaped sides. Each of the dummy terminals 3 includes a terminal portion 5 standing from a press-fit portion 4 to provide a L-shaped side. The press-fit portions 4 of the dummy terminals 3 are inserted into the press-fit grooves 2 of the housing 1 from their side positions.

In this conventional mounting construction for the dummy terminals 3, the terminal portions 5 of the dummy terminals 3 are supported by the press-fit portions 4 with narrow widths and small areas, so that the support intensity for the dummy terminals 3 is weak, the insertion is easy to be loosed, and the accuracy of positioning is low.

As the device is designed to be miniaturized shown in FIG. 13, a ceiling wall of the housing 1 positioned below the dummy terminal 3 becomes thick due to the limitation of the external scales to support the terminal, whereby the internal space for use of the internal components is decreased, the freedom of design is reduced, and a lot of resins are used.

SUMMARY OF THE INVENTION

It is, therefore, a primary object of this invention to provide an improved dummy terminal mounting construction in which the support intensity for a dummy terminal is large, loose of the mechanical construction is reduced and the accuracy of the positioning is high.

According to a first aspect of this invention, there is provided a dummy terminal mounting construction which includes a housing having hook projections disposed on opposing side walls of the housing, a dummy terminal of a C-shape in a plane including at least one projection terminal portion and hook arm portions extending from both ends of the dummy terminal, the hook arm portions being provided with hook holes, wherein the dummy terminal is mounted on the housing by engaging the hook holes with the hook projections. The hook arm portions of the dummy terminal are engaged with the hook projections, whereby the supporting intensity is increased, mechanical loosing is protected, and the positioning accuracy is improved.

According to a second aspect of this invention, there is provided a dummy terminal mounting construction set forth in the first aspect of the invention in which the hook arm portions of the dummy terminal are bent to be L-shaped in a plane, wherein the positioning accuracy is improved by mounting the hook arm portions into the housing.

According to a third aspect of this invention, there is provided a dummy terminal mounting construction set forth in the first aspect of this invention in which a slit is disposed over and in parallel with a whole bottom wall of the housing and near the bottom wall, and a press-fit portion of the dummy terminal raising at least one terminal portion is inserted into the slit from a side position. Thus, the support area for supporting the dummy terminal is broader than that of conventional construction and the support intensity is increased, so that mechanical loosing of the dummy terminal is prevented and the positioning accuracy is improved.

BRIEF DESCRIPTION OF THE DRAWINGS

Other objectives and advantages of this invention will be more readily apparent from the following detailed description provided in conjunction with the following figures, of which.

DETAILED DESCRIPTION OF THE INVENTION

Figure 1A:
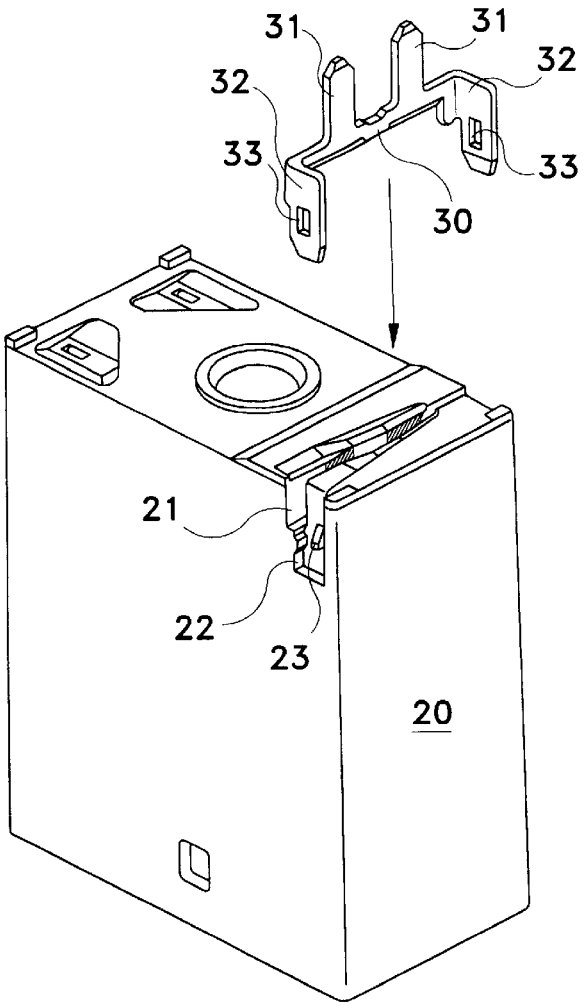
FIG. 1 is an electromagnetic relay provided with a dummy terminal mounting construction as a first embodiment of this invention, and shows at (a) a perspective disassembled view of the relay and at (b) an assembled view thereof.
Figure 1B:
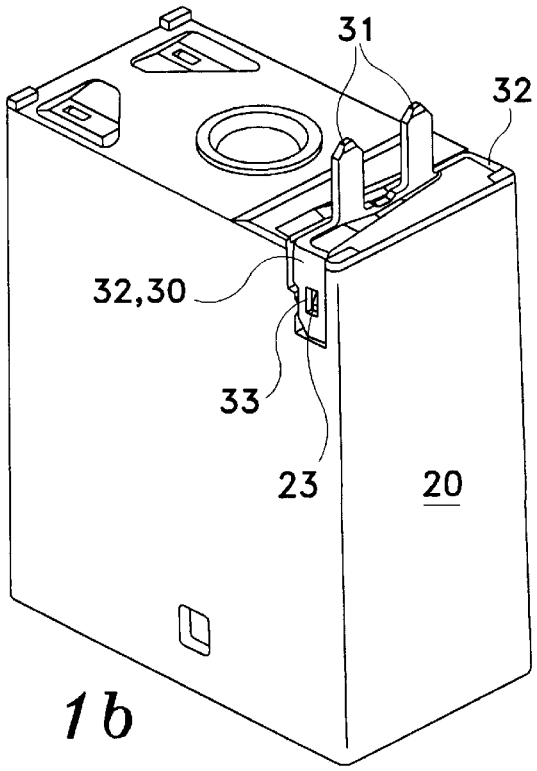
Figure 2:
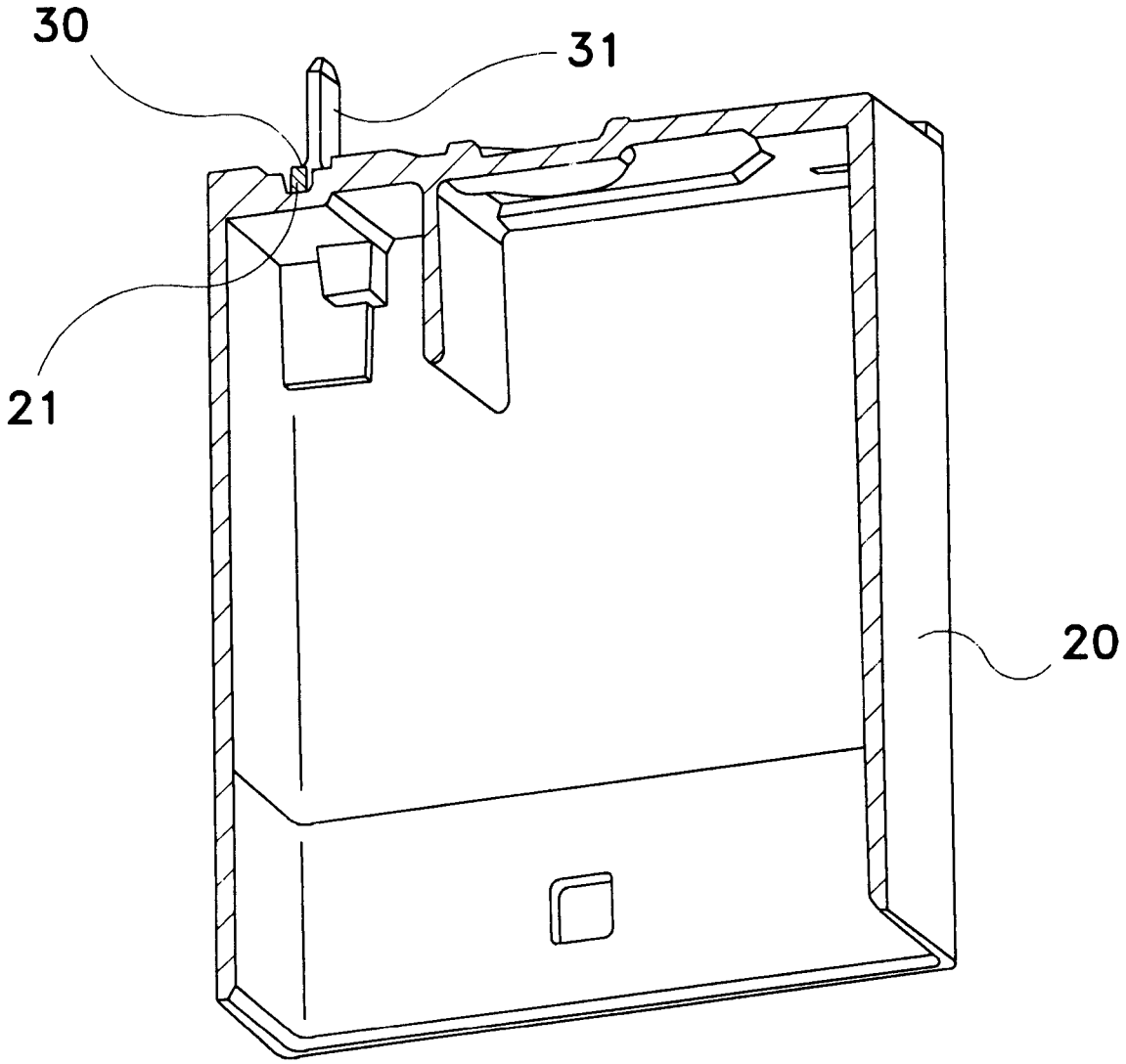
FIG. 2 is a perspective sectional view of a housing of the relay of FIG. 1.
Figure 3:
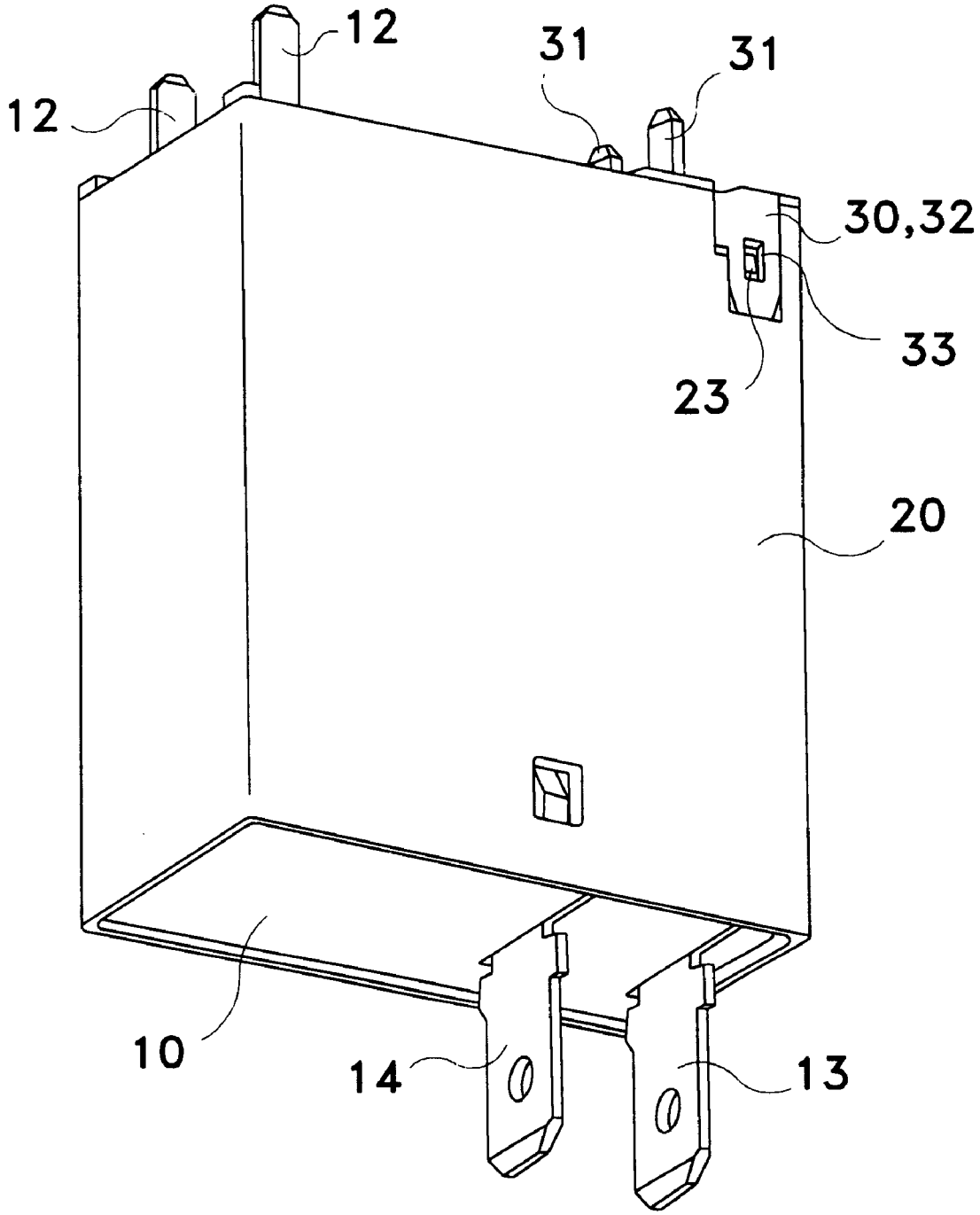
FIG. 3 is a perspective view of the assembled relay.

Referring, now, to FIGS. 1 to 4, there is shown a dummy terminal mounting construction for an electromagnetic relay as a first embodiment of this invention, in which a dummy terminal 30 is adapted to be mounted on a ceiling wall of a box-shaped housing 20 engaged with a base 10.

The housing 20 is provided with a slit 21 of a flat C-shape both ends of which include a pair of longitudinal recesses 22, and a hook projection 23 is provided at a central bottom of each of the recesses 22.

The dummy terminal 30 at a middle thereof includes a pair of projecting terminal portions 31, and at both ends thereof is bent along a thickness direction thereof to provide hook arm portions 32, which is of about C-shape in a plane. The hook arm portions 32 are provided with hook holes 33 hooked by the hook projections 23 of the housing 20.

Figure 4A:
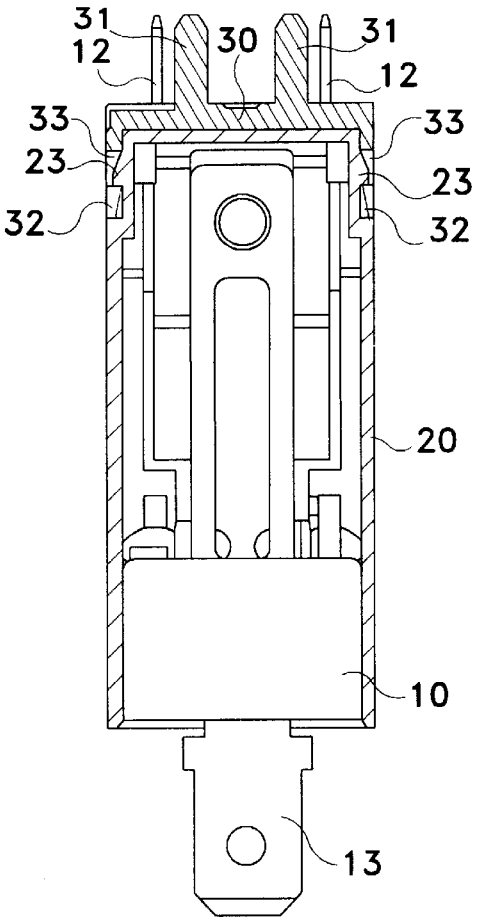
FIG. 4 shows at (a) side sectional view of the relay of FIG. 3, and at (b) a front sectional view thereof.
Figure 4B:
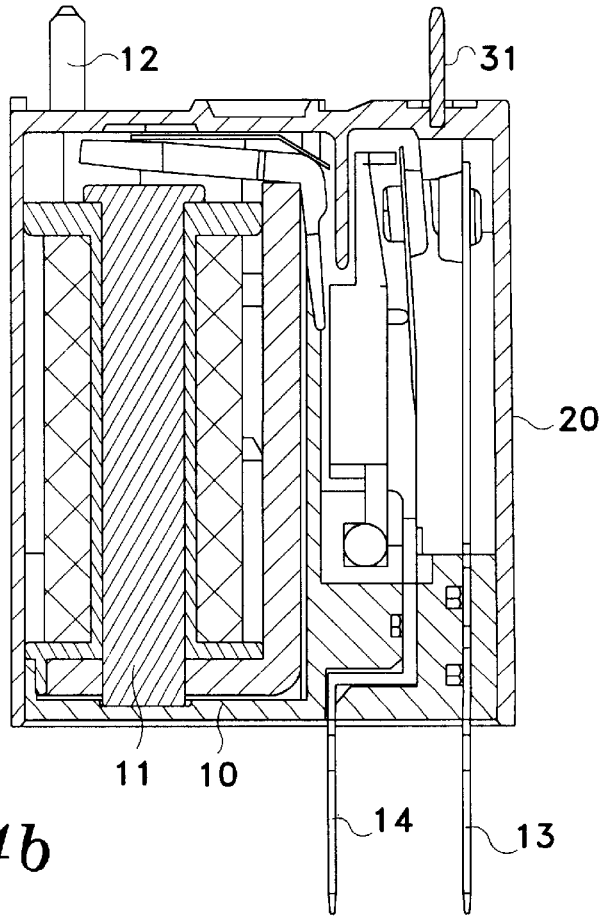

As shown in FIG. 4, the base 10 mounted by internal components including an electromagnet portion 11, a coil terminal 12, a stationary contact terminal 13, and a movable contact terminal 14 is mounted by the housing 20, and a seal member (not shown in drawings) is injected into base portions of the coil terminals 12 and the dummy terminal 30 projecting from the ceiling wall of the housing 20 to be solidified for fixing the position.

According to this embodiment, the dummy terminal 30 is mounted over a full width of the ceiling wall of the housing 20 so that the area to be injected and solidified by the seal member may be broad. When the position of the terminal portion 31 is same as a position extending from tho stationary contact terminal 13, a sealing process may be made in a conventional manufacturing line for a conventional electromagnetic relay in which a terminal for a printed circuit board is disposed on a line extending from a stationary contact terminal, and a sealing machine may be set to be used as it is, which is convenient. Moreover, an external force in an axial direction to be loaded to the terminal portion 31 is received by the hook projection 23 through the hook arm portion 32, the ceiling wall of the housing 20 is not necessary to be thick for strengthening. Thus, the ceiling wall of the housing 20 may be thin, so that the internal space may be sufficiently ensured and the freedom of the design is improved.

Figure 5A:
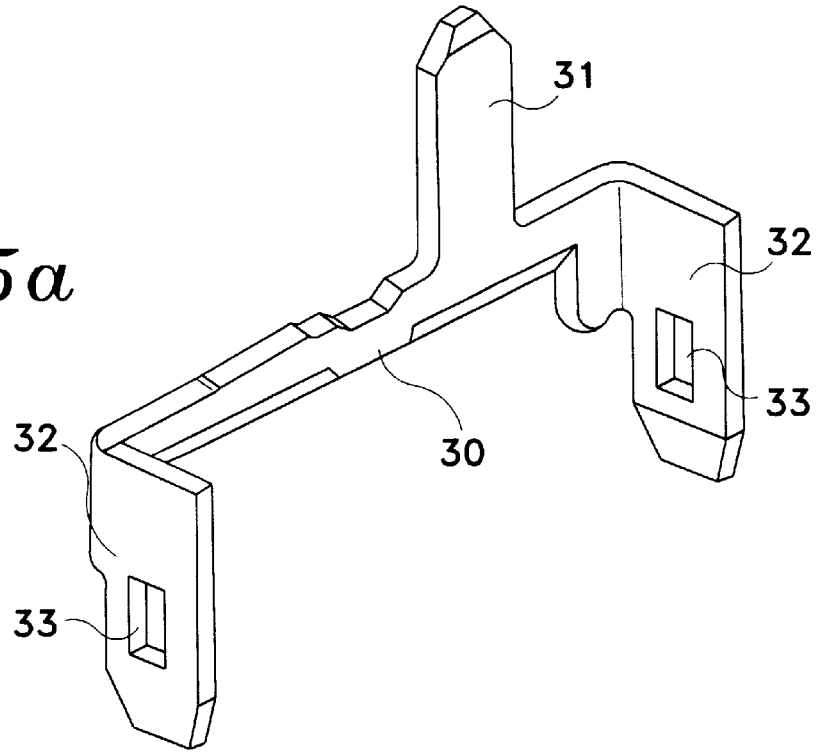
FIG. 5 shows at (a) a perspective view of a dummy terminal and at (b) a perspective mounted view on an electromagnetic relay as a second embodiment of this invention.
Figure 5B:
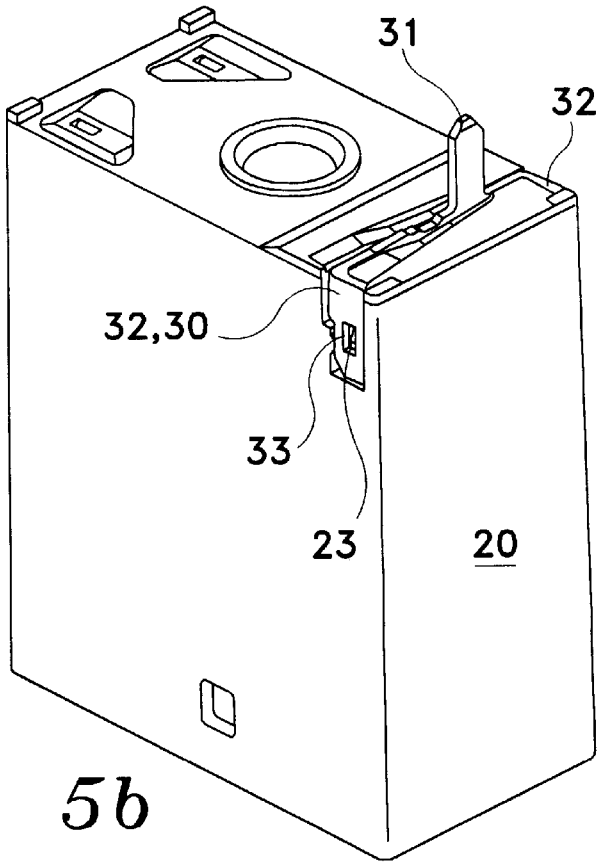

FIG. 5 shows at (a) a dummy terminal 30 and at (b) an electromagnetic relay mounted by the terminal 30 as a second embodiment of this invention, which has a same construction as that of the first embodiment except only one terminal portion 31 projects. Other components are the same as those of the first embodiment, and their explanation will be omitted for a simplified explanation.

According to this second embodiment, devices having different specifications may be made with changing the dummy terminal 30, so that their stock control may be simplified.

Figure 6A:
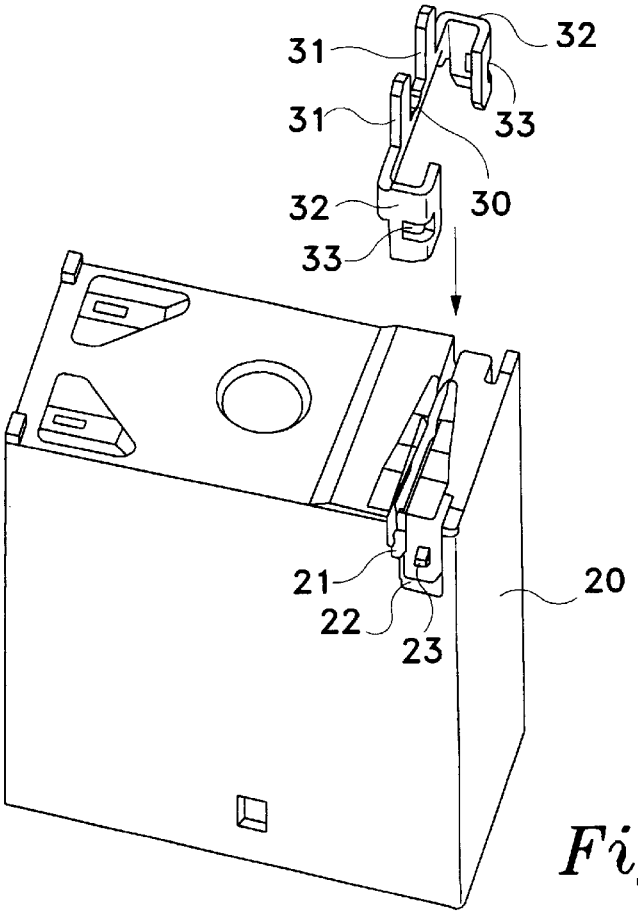
FIG. 6 shows at (a) a perspective dismounted view of an electromagnetic relay and at (b) a perspective mounted view of the relay as a third embodiment of this invention.
Figure 6B:
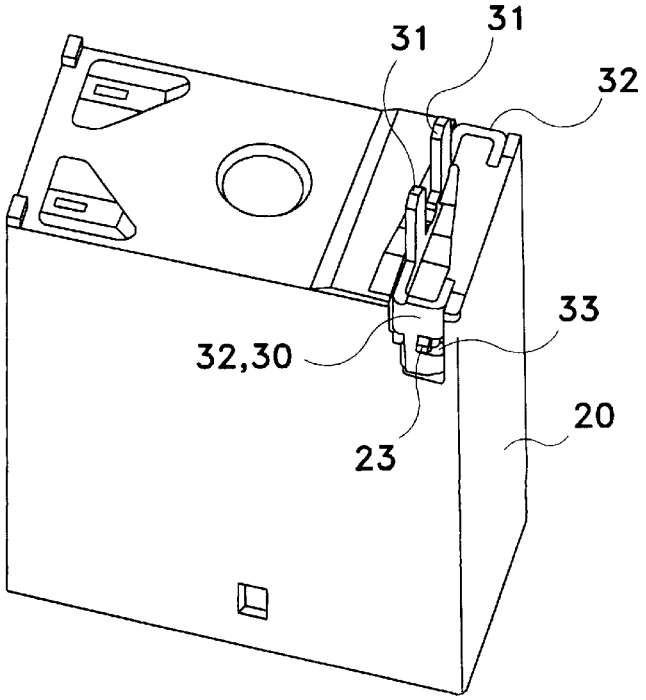
Figure 7:
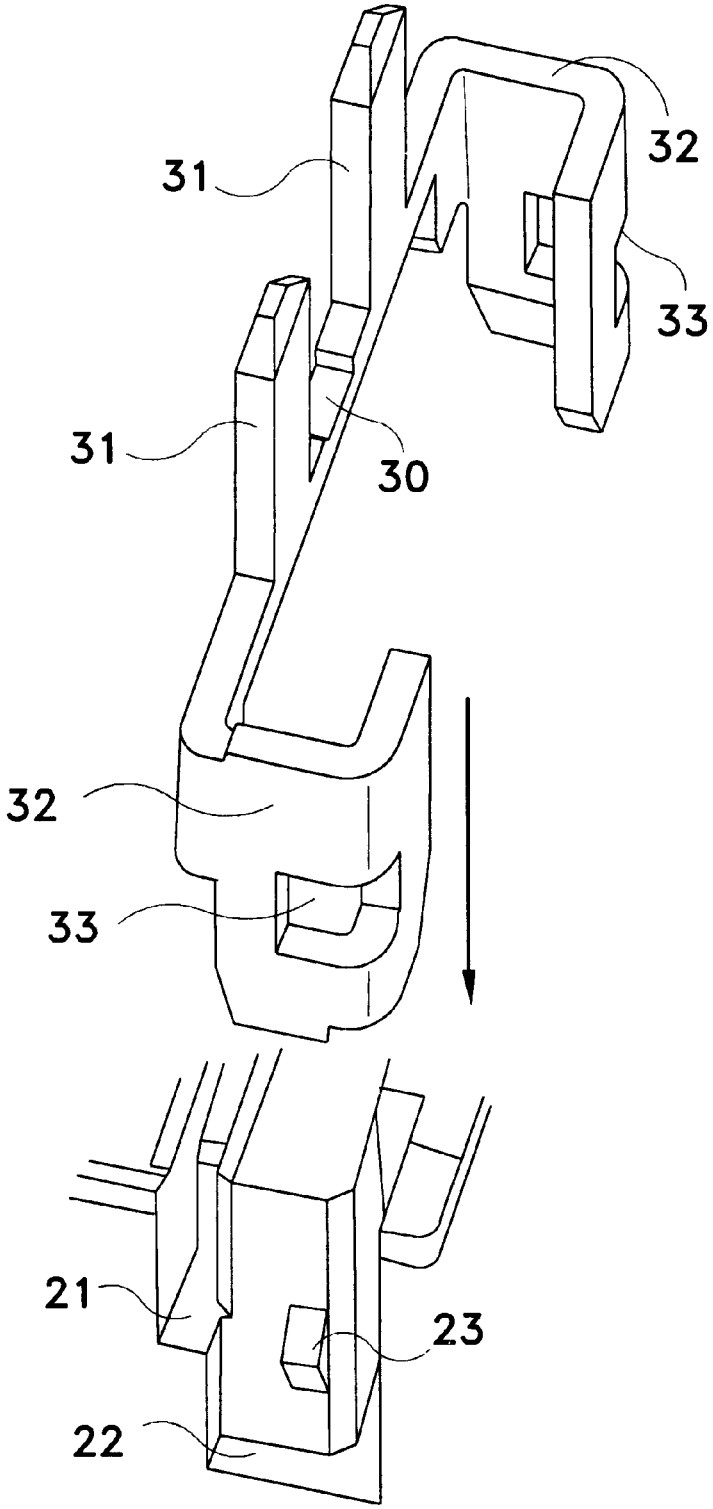
FIG. 7 is an enlarged view of a portion of FIG. 6.

Referring to FIGS. 6 and 7, there is shown an electromagnetic relay provided with a dummy terminal mounting construction as a third embodiment of this invention which is almost same as the first embodiment except hook arm portions 32 of dummy terminal 30 are bent in a L-shape and hook holes 33 are disposed on corners of the arm portions 32. Recess portions 22 of a slit 21 mounted by dummy terminal 30 are of a plane L-shape.

According to this third embodiment of this invention, both ends of the slit 21 are of a plane L-shape, whereby positioning is easier than that of the foregoing embodiments.

Figure 8A:
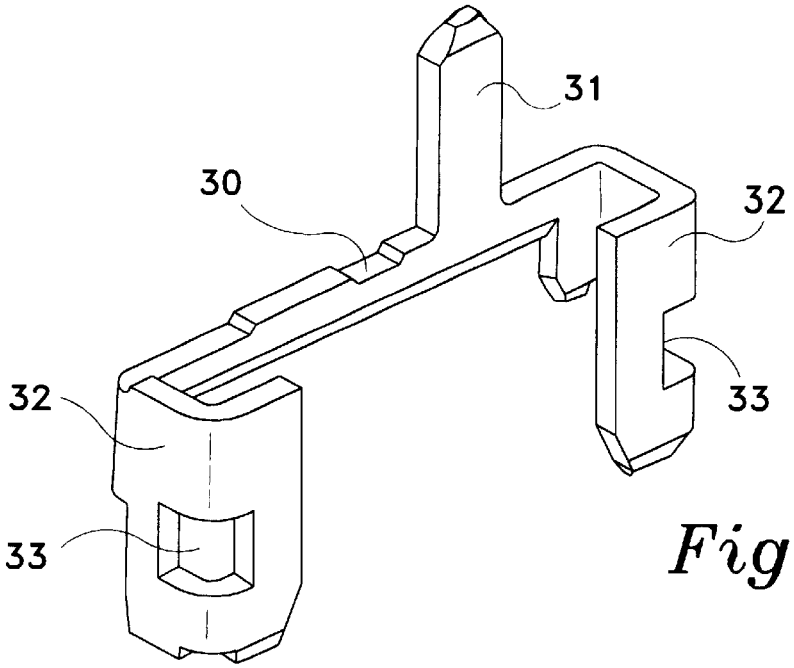
FIG. 8 shows at (a) a perspective view of a dummy terminal and at (b) a perspective mounted view on an electromagnetic relay as a fourth embodiment of this invention.
Figure 8B:
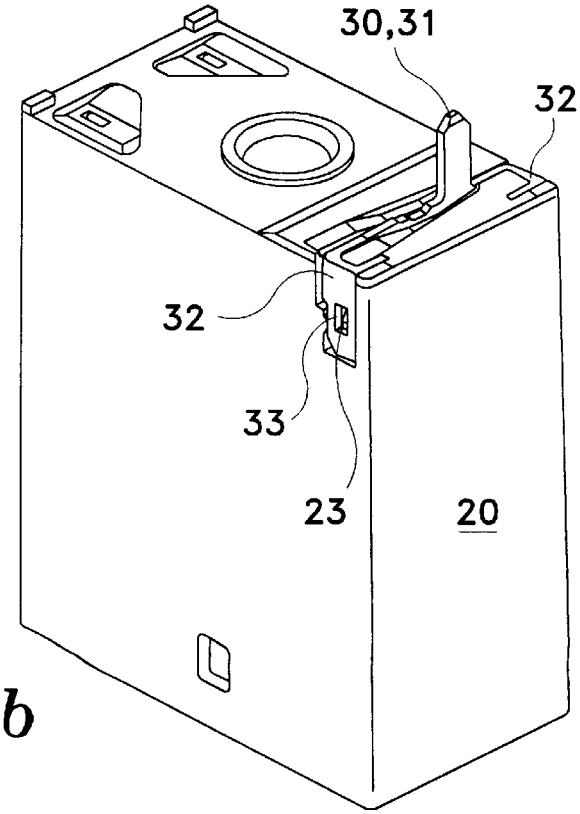

FIG. 8 shows a fourth embodiment of this invention which is almost same as the third embodiment except only one terminal portion 31 projects. Other components are the same as those of the third embodiment, and their explanation will be omitted.

Figure 9A:
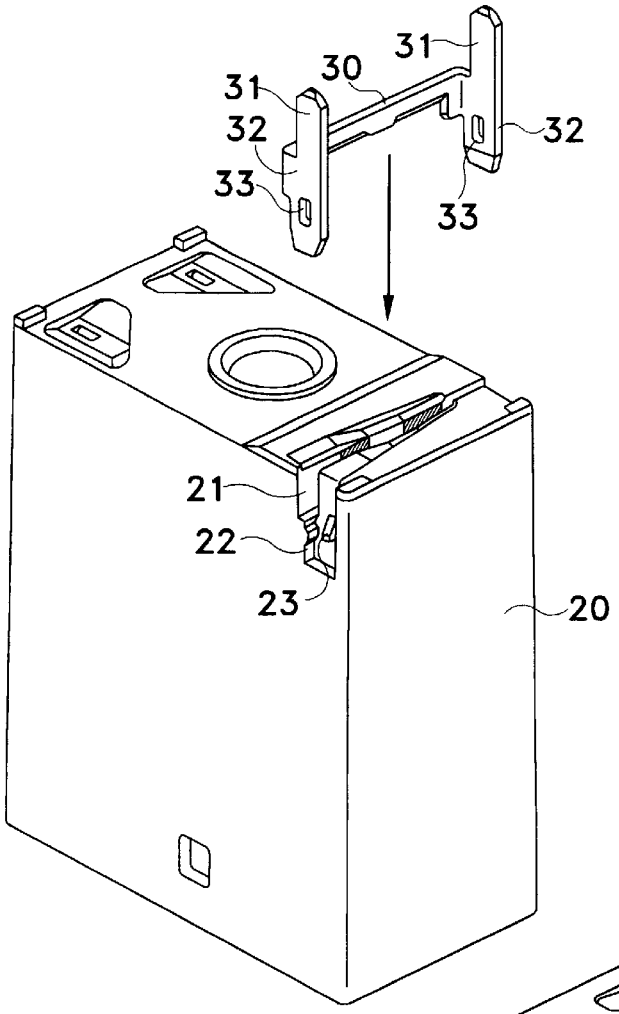
FIG. 9 shows at (a) a perspective dismounted view of an electromagnetic relay and at (b) a perspective mounted view of the relay as a fifth embodiment of this invention.
Figure 9B:
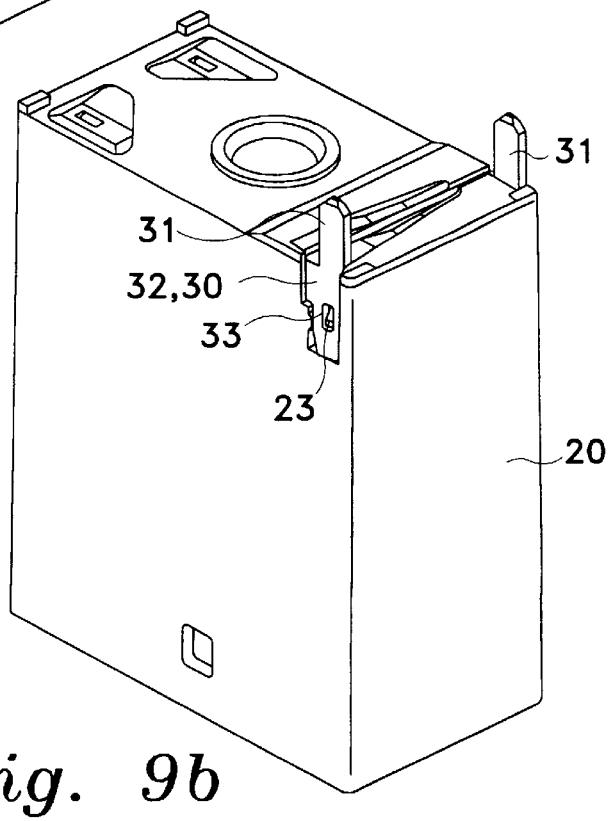

FIG. 9 shows a fifth embodiment of this invention in which terminal portion 31 are extended upwardly from hook arm portions 32. An external force in an axial direction to be loaded to the terminal portions 31 is received by hook projections 23 through hook arm portions 32 just below the terminal portions 31, whereby the support intensity is strengthened.

Figure 10A:
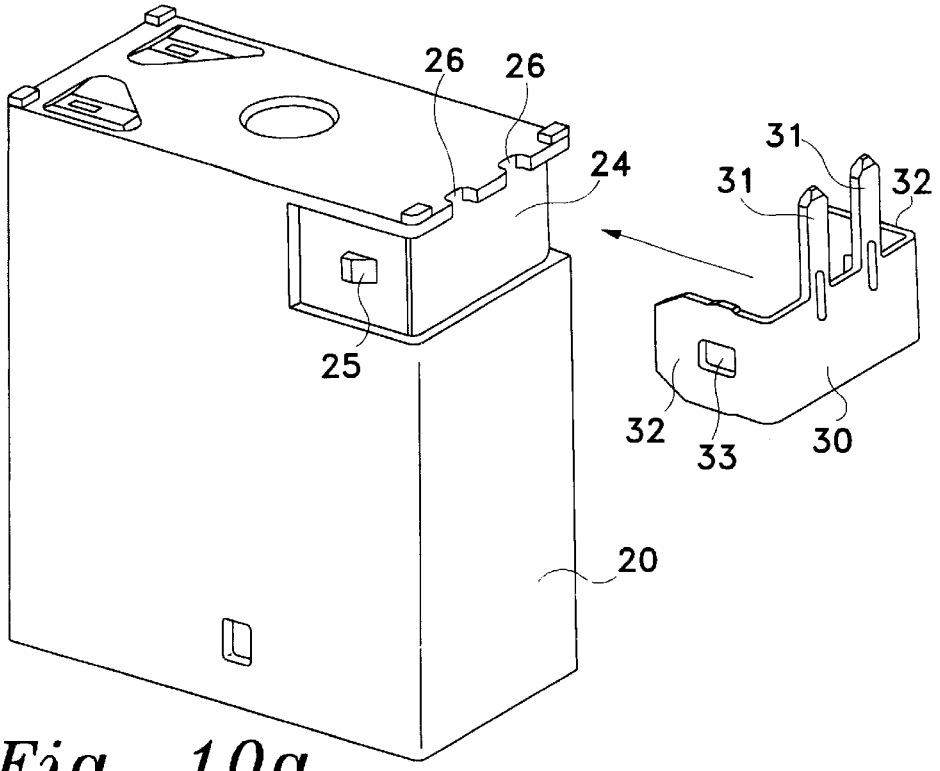
FIG. 10 shows at (a) a perspective dismounted view of an electromagnetic relay and at (b) a perspective mounted view of the relay as a sixth embodiment of this invention.
Figure 10B:
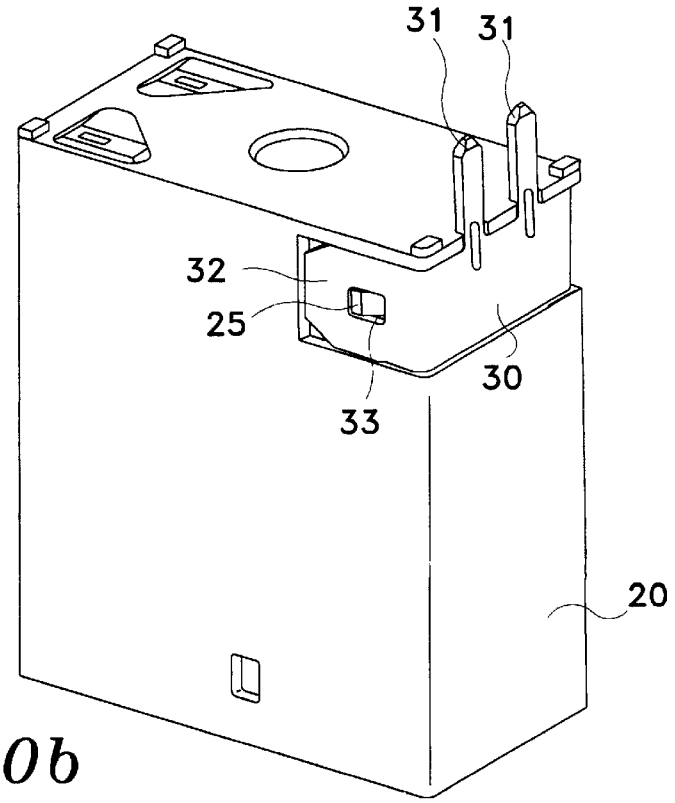

FIG. 10 shows a sixth embodiment of this invention, in which a dummy terminal 30 is mounted on sides near a ceiling wall of housing 20 from their side positions. A C-shaped recess portion 24 is formed near a ceiling wall of the housing 20 along its side faces. On opposing bottom walls of the recess portion 24, there are disposed hook projections 25 (the projection 25 behind not shown in FIG. 10), and cut-out portions 26 engaged with later described terminal portions 31 are disposed at peripheral portions of the housing 20.

The dummy terminal 30 includes hook arm portions 32 bent toward its thickness direction which is of a C-shape in a plane, and a pair of terminal portions 31 are projected.

As the dummy terminal 30 is mounted on the recess portion 24 of the housing 20 from a side position thereof, the hook projections 25 of the housing 20 are engaged with the hook holes 33 of the dummy terminal 30 and the terminal portions 31 are hooked by the cut-out portions 26 of the housing 20.

According to this embodiment, disengagement toward a side direction is protected by the hook projections 25, and vertical falling out is protected by an opening peripheral of the recess portion 24.

Figure 11A:
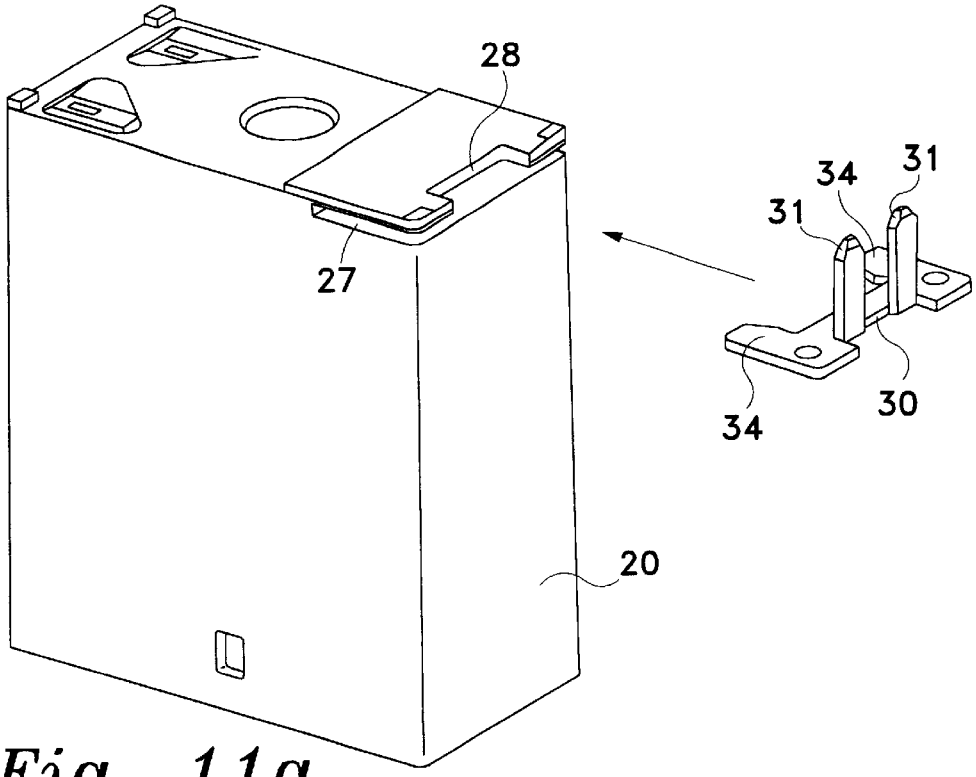
FIG. 11 shows at (a) a perspective dismounted view of an electromagnetic relay and at (b) a perspective mounted view of the relay as a seventh embodiment of this invention.
Figure 11B:
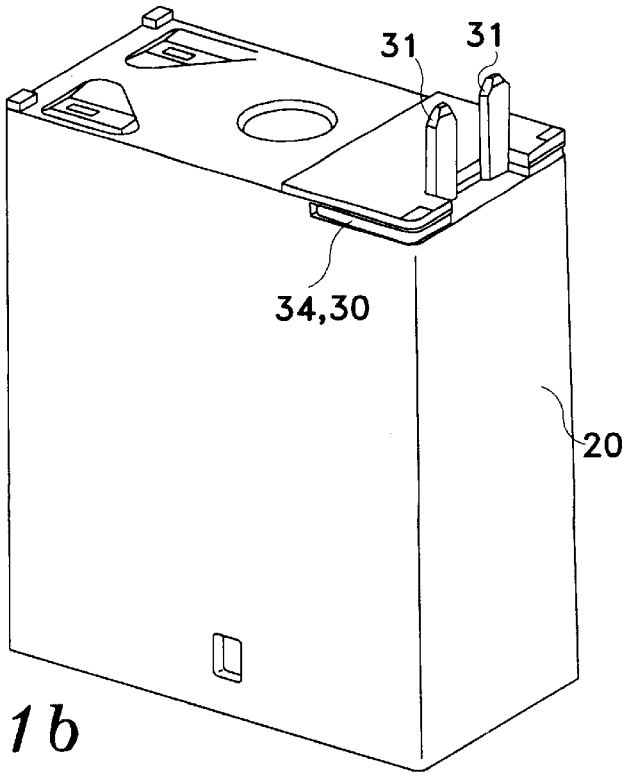
Figure 12A:
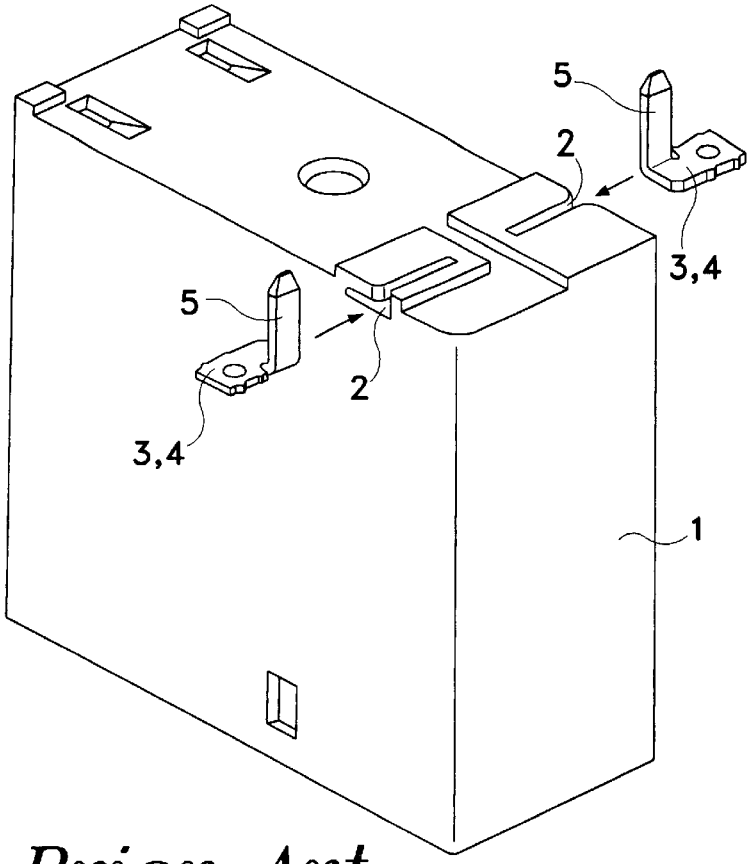
Prior Art Fig. 12a
FIG. 12 is a conventional electromagnetic relay, and shows at (a) a perspective dismounted view thereof and at (b) a perspective mounted view thereof.
Figure 12B:
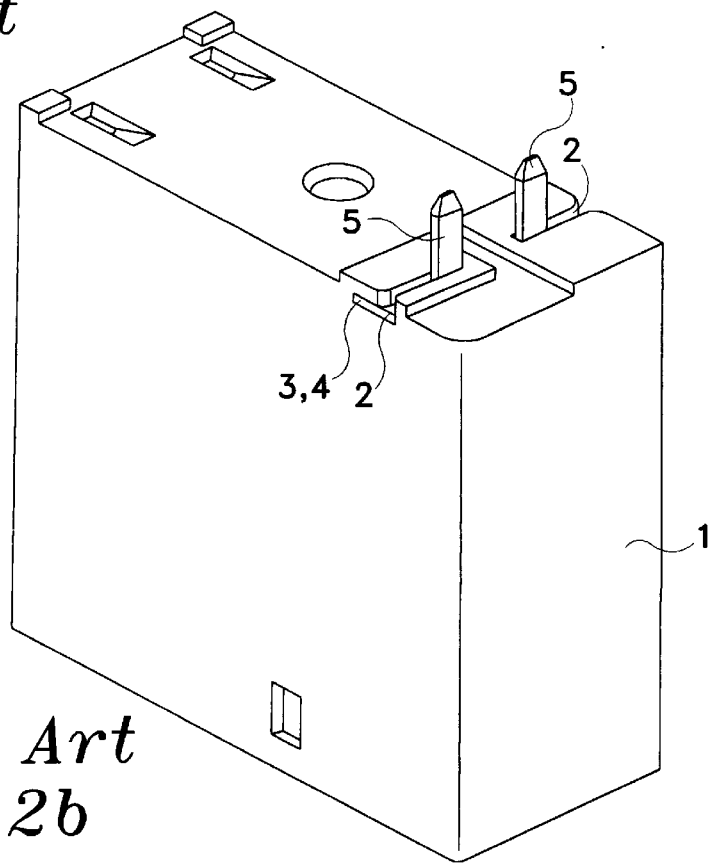
Prior Art Fig. 12b
Figure 13:
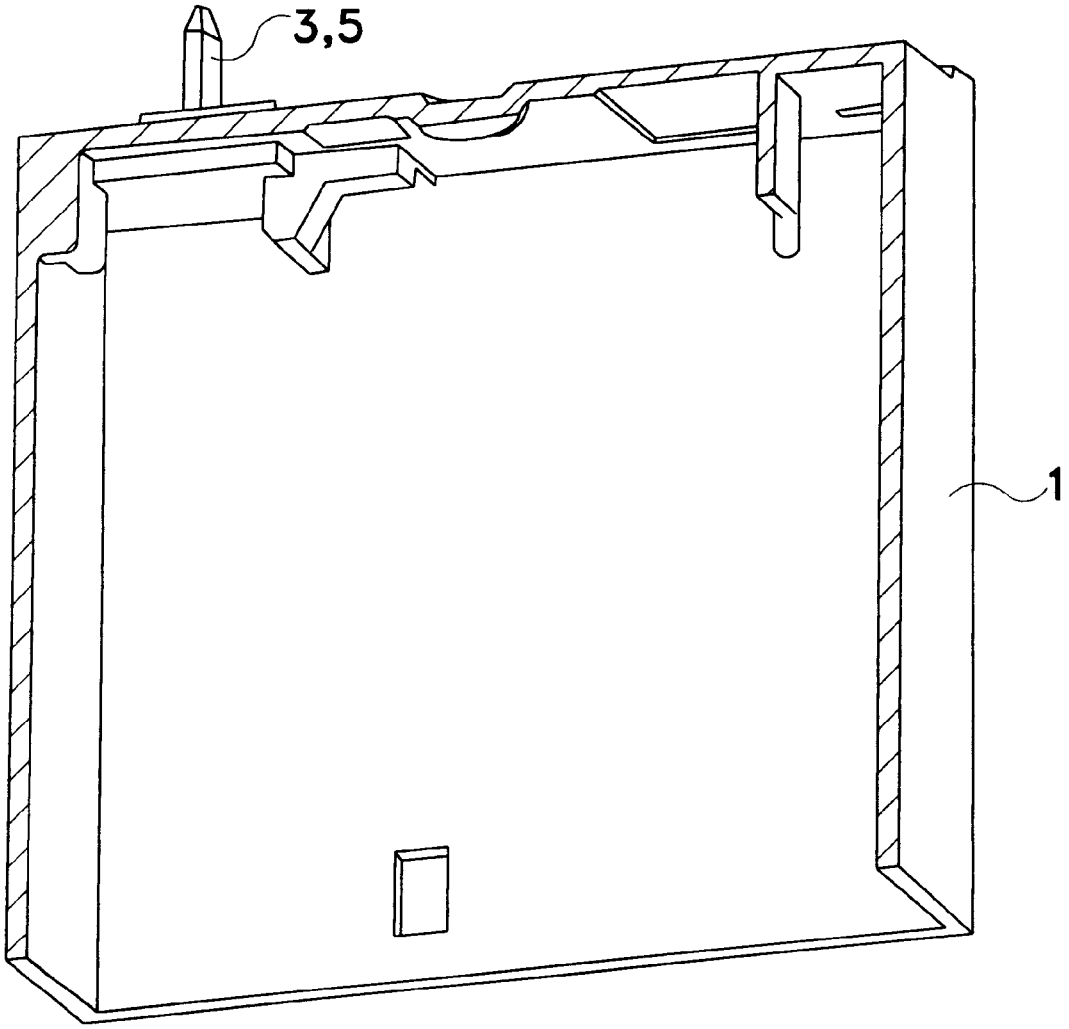
Prior Art Fig. 13
FIG. 13 is a perspective longitudinal sectional view of a housing of the conventional electrode magnetic relay of FIG. 12.

FIG. 11 shows an electromagnetic relay as a seventh embodiment of this invention, in which a slit 27 is formed in parallel with a whole ceiling wall and a cut-out portion 28 is formed by cutting out a portion of the ceiling peripheral. Dummy terminal 30 is provided with press-fit portions 34 formed at bases of a pair of terminal portions 31 which are vertically bent. Accordingly, an assembling work is performed by inserting the dummy terminal 30 into the slit 27 of the housing 20, and engaging the terminal portions 31 with the cut-out portion 28.

According to this embodiment, contact area and support intensity are increased by inserting the press-fit portions 34 of the dummy terminal 30 spreading over a width of the ceiling wall of the housing 20 into the slit 27 of the housing 20, so that loosing is prevented and the positioning accuracy is high.

Though the foregoing embodiments are described about electromagnetic relays, this invention may be applied to other devices such as switches. Though the dummy terminals in the foregoing embodiments are mounted on the ceiling walls of the box-shaped housings, they may be applied to be mounted on bases if desired. The dummy terminals of the foregoing embodiments employ straight portions to be inserted into through-holes of a printed circuit board, but, if desired, may employ terminal portions bent in a L-shape to be mounted on a printed circuit board.

While the invention has been described and illustrated with respect to certain embodiments which give satisfactory results, it will be understood by those skilled in the art, after understanding the purpose of the invention, that various other changes and modifications may be made without departing from the spirit and scope of the invention, and it is therefore, intended in the appended claims to cover all such changes and modifications.

What is claimed is:

1. A dummy terminal mounting construction, comprising a housing including a slit therein and hook projections disposed on opposing side walls of the housing, a dummy terminal of a C-shape in a plane including at least one projection terminal portion and hook arm portions extending from ends of the terminal, each of said hook arm portions defining hook holes, wherein said dummy terminal is mounted on said housing by inserting said dummy terminal into said slit and engaging said hook holes with said hook projections.

2. A dummy terminal mounting construction according to claim 1 in which said hook arm portions are bent to be L-shaped in a plane.

3. A dummy terminal mounting construction, comprising;

a housing including a slit therein and a first hooking member disposed on opposing side walls of the housing, a dummy terminal of a C-shape in a plane including at least one projection terminal portion and hook arm portions extending from ends of the terminal, each of said hook arm portions defining a second hooking member, wherein said dummy terminal is mounted on said housing by inserting said dummy terminal into said slit and engaging said first hooking member with said second hooking member.

* * * * *